United States Patent [19]

Seiferth et al.

[11] 4,097,611

[45] Jun. 27, 1978

[54] SLICED FOOD PACKAGE WITH SIDE WINDOWS

[75] Inventors: Oscar E. Seiferth; Calvin T. Royston, both of Madison, Wis.

[73] Assignee: Oscar Mayer & Co. Inc., Madison, Wis.

[21] Appl. No.: 341,390

[22] Filed: Mar. 15, 1973

[51] Int. Cl.[2] ..... B65D 85/72; B65B 25/06

[52] U.S. Cl. ..... 426/121; 206/45.31; 206/45.34; 229/87 F; 426/124

[58] Field of Search ..... 426/106, 121; 229/87 F; 206/45.34, 45.31

[56] References Cited

U.S. PATENT DOCUMENTS

| | | | |
|---|---|---|---|
| 1,912,952 | 6/1933 | Scruby | 206/45.31 X |
| 2,097,858 | 11/1937 | Herz | 206/45.31 |
| 2,844,473 | 7/1958 | Seiferth et al. | 426/121 |
| 2,980,316 | 4/1961 | Buttery et al. | 229/87 F |
| 3,137,435 | 6/1964 | Meyers | 206/45.31 |
| 3,168,952 | 2/1965 | Palmer | 206/45.34 X |
| 3,199,670 | 8/1965 | Palmer | 206/45.34 |
| 3,423,005 | 1/1969 | Leibson et al. | 206/45.31 |
| 3,591,069 | 7/1971 | Heller, Jr. et al. | 206/45.31 X |
| 3,730,335 | 5/1973 | Tarrson | 206/45.31 |
| 3,803,332 | 4/1974 | Seiferth et al. | 426/121 |
| 3,835,988 | 9/1974 | Buttery | 206/45.31 |

*Primary Examiner*—Steven L. Weinstein

*Attorney, Agent, or Firm*—Lockwood, Dewey, Zickert & Alex

[57] ABSTRACT

A folding paperboard carton having an improved window construction in an elongated rectangular side panel. A preferred embodiment is a rhomboidal carton for sliced and shingled bacon. The side window construction comprises an elongated rectangular piece of non-wrinkling clear plastic which is adhered to the inner surface of the window aperture-containing side panel. The non-wrinkling plastic piece has one edge aligned with a score line between the side panel and top panel. The score line is discontinuous because of the presence of the window openings in the side panel having partitions therebetween hinged to the top panel at the score line. The combined stiffness provided by the apertured side panel and adhered plastic piece serves to cause the discontinuous score line to fold when the tubular carton is erected for filling from its manufactured flat condition.

3 Claims, 7 Drawing Figures

FIG. 1
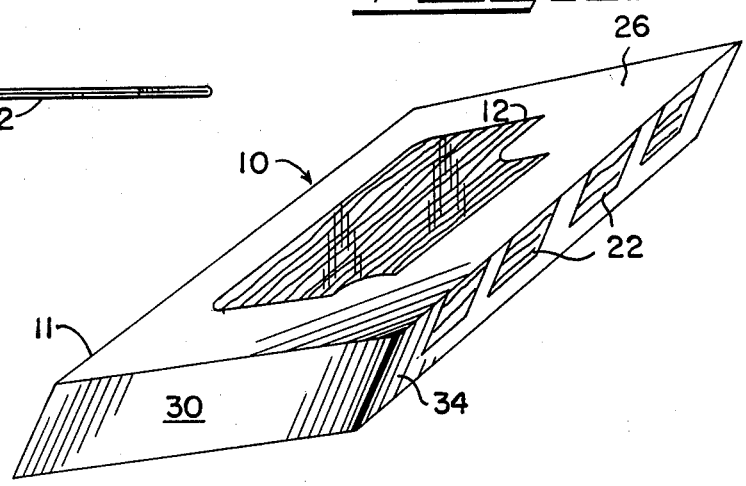
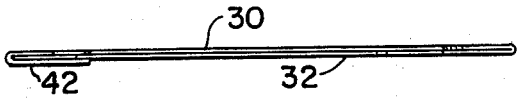
FIG. 2
FIG. 3
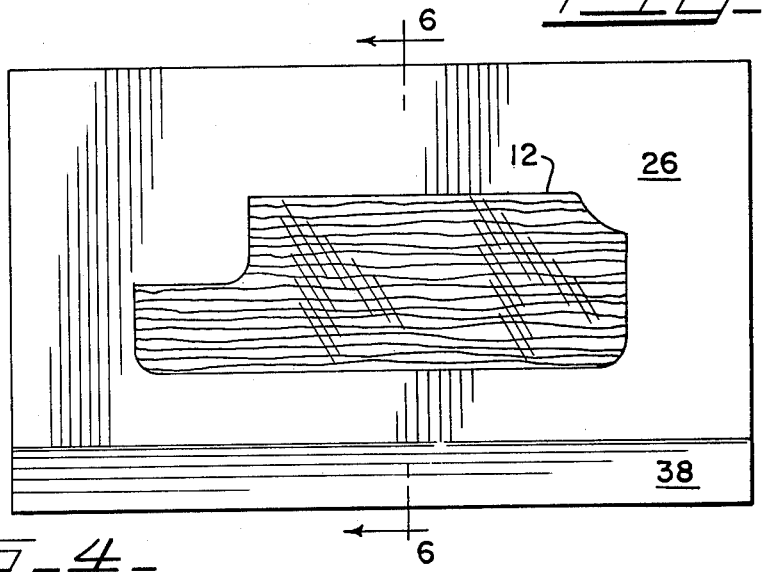
FIG. 4
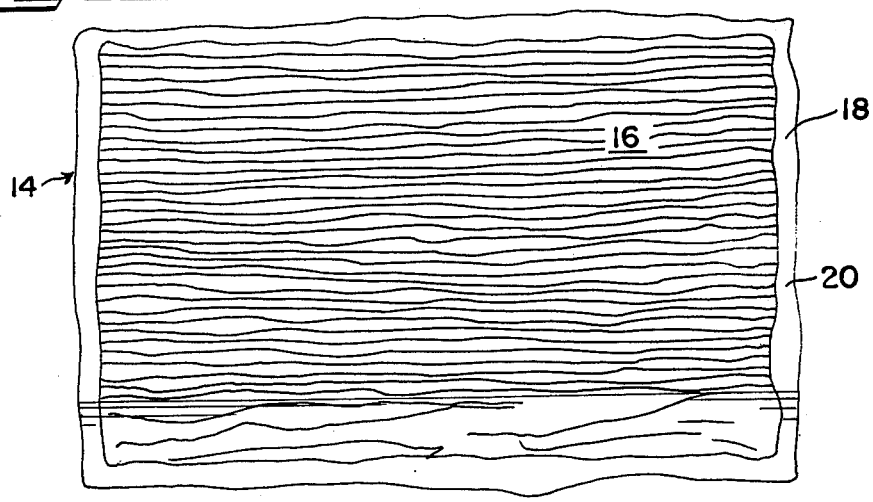

SLICED FOOD PACKAGE WITH SIDE WINDOWS

This invention relates to packaging and is more particularly concerned with improvements in a package having side windows. The container of the present invention is particularly useful in packaging sliced bacon and is particularly suitable for erection from the flat condition.

Bacon is commonly marketed in predetermined quantities in sliced, shingled condition in packages having a window at the top of the package. The window in the top of the package, such as a bacon package, permits the consumer to inspect one side of the contents without opening the package and without contamination of the contents. One satisfactory rhomboidal sliced food package is described in U.S. Pat. No. 2,844,473, issued July 22, 1958 to the inventors herein. The package disclosed in the aforementioned patent includes a window in the top which also extends part way down an adjacent side panel. In the package described in U.S. Pat. No. 2,844,473, the window opening is covered by a single sheet of transparant film material. This construction enables consumers to inspect the lean top edges of a shingled array of bacon slices and to some extent the side of an end slice.

The present invention provides a folding paperboard bacon carton wherein a side panel has substantially greater window area than prior cartons so as to enable the customer to readily view a much greater portion of the end slice of a stack of sliced bacon in the carton. A difficulty encountered in the erection of such a carton having large window areas in the side panel is on erection from the flat condition folds tend to develop randomly in the side panel having the window apertures since the normal stiffness is weakened by the removal of material for the windows. During erection, all panels should readily fold only along the score lines extending between interconnected edges of the top, bottom and side panels.

It is desirable to produce the individual folding bacon cartons from blanks and in a flattened tubular condition with the end flaps and tabs unfolded so that the cartons can be shipped and stored flat. Stacks of such flattened tubular cartons can be fed through suitable magazine or other feeding and packaging apparatus for mechanical erection wherein the extreme opposite folding lines between the joined panels of each flattened tubular carton are mechancially urged toward each other, thereby erecting the carton for product insertion.

The placing of a large window area in the side of such a folding carton or package necessitates removing from the side panel a substantial area of the paperboard material, thereby weakening that side as mentioned. During mechanical erection, the substantial weakening of the side panel tends to result in folding or buckling occurring in the side panel itself rather than in a single straight-line fold occurring along the desired score line between the top and side panels.

Any folding or buckling of the side panel, whether it occurs during the handling, shipping, or consumer display phases, or whether it occurs during the high-speed mechanical erection, results in a package product having an undesirable abused appearance. Also, such buckling may result in dislocation of or damage to the plastic sheet window during filling the cartons when the contents of the packages are inserted in the erected cartons at high speeds.

It is an object of the present invention to provide a carton and package of the type described having relatively large side windows, which package is particularly suitable for high-speed mechanical erection wherein all the respective panels fold properly along the score lines formed in the manufacture of the carton blanks.

It is another object of the present invention to provide a carton and package having relatively large side windows including a sheet of flexible semi-rigid transparant plastic which does not buckle during the high-speed mechanical erection of the tubular carton from its flattened condition or in use.

These and other objects which will be apparant hereinafter all are achieved in accordance with the present invention, which is described herein in connection with the preferred embodiments, and with the aid of the accompanying drawings in which:

FIG. 1 is a perspective view of a rhomboidal bacon package having windows in one side panel in accordance with the present invention.

FIG. 2 is an end view of the carton used in the package shown in FIG. 1 in collapsed or flat condition.

FIG. 3 is a top plan view of the package shown in FIG. 1.

FIG. 4 is a top view of an inner package of bacon separately wrapped in a vacuum skin-tight transparant plastic wrapper which is placed inside the package shown in FIG. 1.

Figure 7:
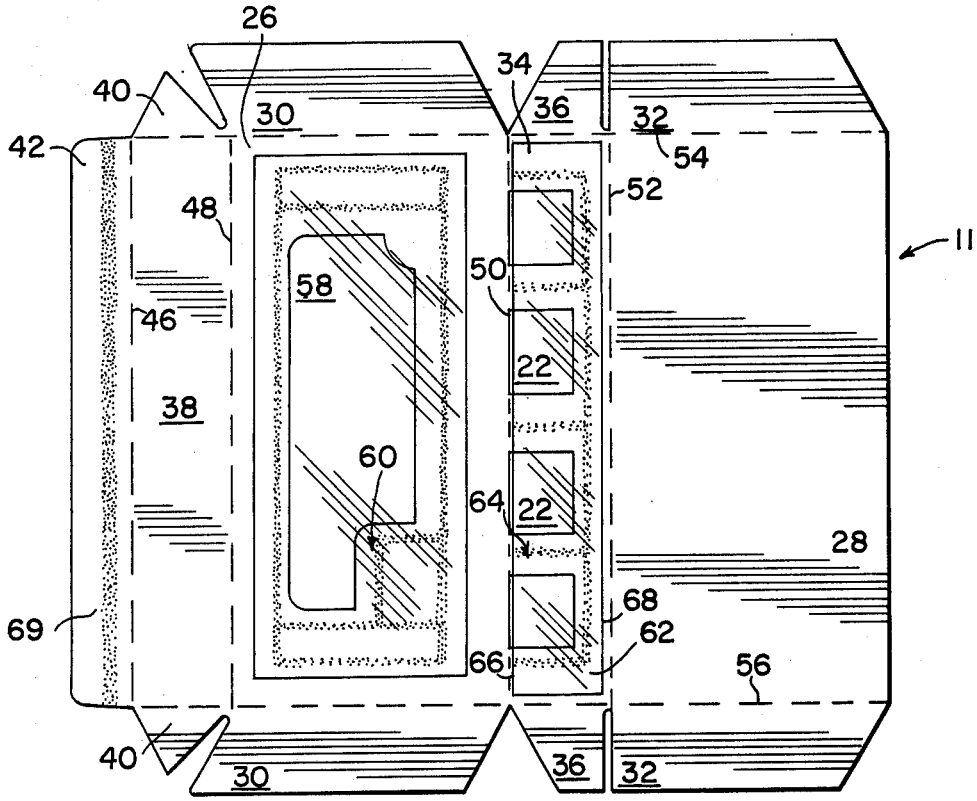
FIG. 7 is a plan view of the carton blank of the folding carton of FIGS. 1–6 with the two plastic windows in place thereon.
Figure 6:
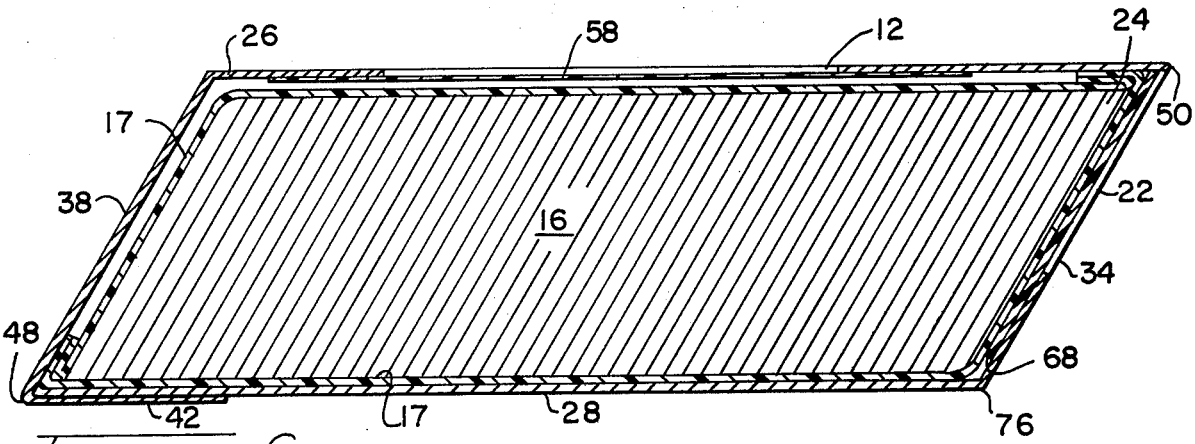
FIG. 6 is a cross-sectional view taken approximately along the lines 6—6 of FIG. 3.
Figure 5:
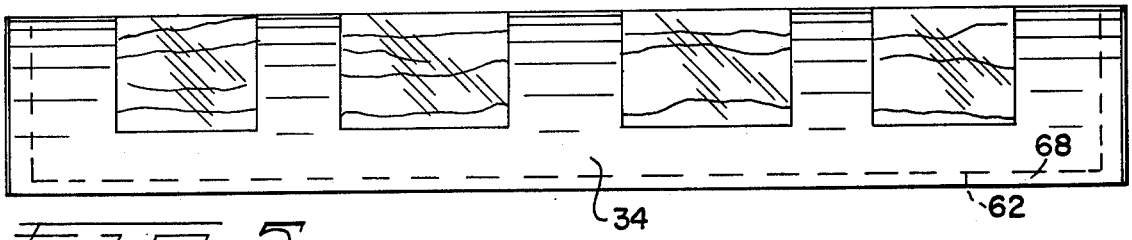
FIG. 5 is a side elevational view of the package shown in FIG. 1 as viewed toward the side shown at the right-hand of FIG. 1.

In the accompanying drawings, a package embodying the present invention is generally indicated by the numeral 10. Package 10 has a top window 12 through which the contents may be viewed from one side, an inner evacuated package 14 of separately wrapped shingled bacon slices, the separate wrap being provided by a skin-tight transparant plastic wrapper 18.

While the window 12 gives a view of the lean edges only of the bacon slices, package 10 also has a plurality of side windows 22—22 which permit inspection of substantially the full width of end slice 24 of bacon, or the corresponding surface of any other article within package 10.

Referring now to FIG. 7, the outer carton or container 11 for the package 10 is formed in known manner from a blank of paperboard which by score lines is divided into panels to provide a top panel 26, bottom panel 28, top end flaps 30—30, bottom end flaps 32—32, window-containing side panel 34, window panel end tabs 36—36, access panel end tabs 40—40, and closure flap 42. The angularity of the cuts which determine the edge-shape of end flaps 30—30, 32—32 and end tabs 36, 40 is conventional for a rhomboidal carton and the package can be formed by folding the respective panels and tabs along score lines indicated in FIG. 7 by broken lines, and identified by the numerals 46, 48, 50, 52, 54 and 56.

However, before the paperboard blank is folded, a piece of transparant plastic film 58 is secured to the inner surface of top panel 26 by adhesive positioned along the stipled area generally indicated by the numeral 60 (FIG. 7). A piece 62 of transparant flexible plastic sheet material is secured to window panel 34 by means of adhesive applied to panel 34 along the stipled areas generally indicated by the numeral 64, which extend upwardly along the bands of paperboard 65—65 dividing individual window apertures 22—22.

The piece 58 of transparant plastic film is dimensioned to amply overlay the margins of window 12 to provide ample carton-plastic interface for the adhesive 60. The piece 58 of plastic film can be relatively thin and wrinklable, and is preferably selected from those plastics which will provide sufficient ultraviolet shielding to prevent substantial adverse effects from being developed on the product 16 within the package 10.

The piece 62 of transparant plastic sheet is semi-rigid so as to have flexibility but be stiff enough not to wrinkle. It is dimensioned to extend approximately to the ends of side panel 34. Upper edge 66 of sheet 62 is positioned approximately on score line 50 which is interrupted by the windows 22—22, and lower edge 68 is positioned a substantial distance below side windows 22—22.

In a preferred embodiment of the present invention, panels 34 and 28 of blank 24 are initially folded on the interrupted score line 50 to bring panels 34 and 28 to a position in which they lie flat on panels 38 and 26. Closure flap 42 is then folded on score line 46 and adhered to the exterior of panel 28 as shown in FIG. 2. In this condition, the carton is in its flat or collapsed condition with flaps 30, 32 and tabs 36, 40 remaining foldably connected to their respective panels along score lines 54 and 56 but otherwise not secured to any other portion of the carton. In this flat condition, stacks of cartons can be shipped to the point of use and a minimum of space is required during shipment.

When the cartons are to be filled, they can be erected either by hand or known mechanical equipment (not shown because conventional). During erection, inwardly directed pressure is exerted along the oppositely positioned fold lines 48 and 52 and this causes panels 28, 34, 26 and 38 connected along score lines 52, 50 and 48, respectively, with respect to one another. In particular, this causes side panels 34 and 38 to pivot upwardly elevating top panel 26 and forming an open ended parallelogram tube or sleeve capable of receiving product 16 therein through either open end. Thereafter, end flaps 30—30, 32—32, and tabs 36—36 are appropriately folded in an obvious manner to close the ends of the package. It will be appreciated that one end of the erected carton could be closed and then the contents inserted from the remaining open end.

It is to be understood, in accordance with the present invention, the stiffness provided by the adhering of the piece 62 of plastic sheet to panel 34 combined with the stiffness of the bands 65 is sufficient to cause the panel 34 to fold only on the discontinuous or interrupted score line 50 when the carton is erected from its manufactured flat condition.

It will be appreciated that the assembled package 10, in accordance with the present invention, provides an emminently satisfactory bacon package having clear and unwrinkled side windows 22 which permit inspection of the outer side of an end piece 24. Yet, the provision of side windows 22 in accordance with the present invention does not have a detrimental effect on the strength of the package, or on the capability of satisfactory stacking a plurality of packages 10 one upon the other.

Furthermore, it has been observed that when package 10 is squeezed by pressing panels 26–28 toward each other in the vicinity of window-containing side panel 34, relatively stiff plastic sheet 62 adopts a smoothly curving configuration which is imparted to bands 65 which are adhered to sheet 62. Thus, upon release of the compressing forces, side panel 34, being adhered to stiff resilient sheet 62 immediately snaps back into its original flat configuration with minimal wrinkling or other defects which would be suggestive of product abuse.

We claim:

1. A folding carton formed of paperboard and erectable from a flat sleeve or collapsed tube condition so as to have a top panel which includes a window opening glazed with transparent film having relatively low resistance to wrinkling, a bottom panel and two sidewall panels with projecting unfolded end flaps on opposite ends of said panels by pivoting said panels along panel-interconnecting score lines, at least one sidewall panel having at least one window opening therein with each sidewall window opening extending all the way to one of its adjacent score lines which is interrupted by the presence of each window opening, said sidewall window opening or openings in aggregate being at least of such area that the material remaining in said side panel containing said window opening or openings will not provide sufficient residual stiffness to consistently initially fold or hinge only along said interrupted score line on erection from said flat or collapsed condition, and a relatively stiff substantially non-wrinkling piece of transparent window glazing material adhered to said sidewall containing said window opening or openings with one edge thereof substantially coincident with said interrupted score line, the stiffness of said piece of transparent window glazing material combined with the residual stiffness of said window sidewall panel to prevent folding or creasing of said window sidewall panel on erection except along said interrupted score line.

2. The improvement of claim 1 wherein said one sidewall contains a plurality of rectangular window openings with rectangular bands of sidewall material intermediate said window openings.

3. A bacon package comprising a stack of shingled bacon slices contained within an inner transparent hermetically sealed envelope disposed within a closed folding carton formed of paperboard and erectable from a flat sleeve or collapsed tube condition so as to have a top panel which includes a window opening glazed with transparent film having relatively low resistance to wrinkling and through which the lean edges of said bacon slices are visible, a bottom panel and two sidewall panels with projecting unfolded end flaps on opposite ends of said panels by pivoting interconnected panels along panel-interconnecting score lines, at least one sidewall panel of said folding carton having at least one window opening therein with each window opening extending all the way to one of its adjacent score lines which is interrupted by the presence of each window openings, said window opening or openings in aggregate being at least of such area that the material remaining in said side panel containing said window opening or openings will not provide sufficient residual stiffness to consistently initially fold or hinge only along said interrupted score line on erection from said flat or collapsed condition, and a relatively stiff substantially non-wrinkling piece of transparent window glazing material adhered to said sidewall containing said window opening or openings with one edge thereof substantially coincident with said interrupted score line, the stiffness of said piece of transparent window glazing material combined with the residual stiffness of said window sidewall panel to prevent folding or creasing of said window sidewall panel on erection except along said interrupted score line, said stack of shingled bacon slices in said hermetically sealed envelope having one end slice juxtaposed to said sidewall panel having said window opening or openings therein whereby the major portion of one side of said end slice is visible.

* * * * *